US007799501B2

(12) United States Patent
Zhang et al.

(10) Patent No.: US 7,799,501 B2
(45) **Date of Patent: *Sep. 21, 2010**

(54) PHOTORECEPTORS

(75) Inventors: Lanhui Zhang, Webster, NY (US); Lin Ma, Webster, NY (US); Keith T. Wong, Vancouver, WA (US)

(73) Assignee: Xerox Corporation, Stamford, CT (US)

( * ) Notice: Subject to any disclaimer, the term of this patent is extended or adjusted under 35 U.S.C. 154(b) by 532 days.

This patent is subject to a terminal disclaimer.

(21) Appl. No.: 11/809,316

(22) Filed: May 31, 2007

(65) Prior Publication Data

US 2008/0299484 A1 Dec. 4, 2008

(51) Int. Cl.
*G03G 9/087* (2006.01)

(52) U.S. Cl. ..... 430/133; 430/127

(58) Field of Classification Search ..... 430/127, 430/133

See application file for complete search history.

(56) References Cited

U.S. PATENT DOCUMENTS 4,265,990 A 5/1981 Stolka et al.
4,286,033 A 8/1981 Neyhart et al.
4,291,110 A 9/1981 Lee
4,338,387 A 7/1982 Hewitt
4,346,158 A 8/1982 Pai et al.
4,654,284 A 3/1987 Yu et al.
5,473,064 A 12/1995 Mayo et al.
5,521,306 A 5/1996 Burt et al.
6,057,075 A 5/2000 Yuh et al.
6,156,468 A 12/2000 Wehelie et al.
6,177,219 B1 1/2001 Yuh et al.
6,255,027 B1 7/2001 Wehelie et al.
6,790,573 B2 9/2004 Drappel et al.
6,800,411 B2 10/2004 Tong et al.
6,818,366 B2 11/2004 Qi et al.
6,824,940 B2 11/2004 Wu et al.
7,056,962 B2 * 6/2006 Johnson et al. ..... 523/205
7,270,926 B2 * 9/2007 Zhang et al. ..... 430/59.4
7,462,431 B2 * 12/2008 Chen et al. ..... 430/58.8
2004/0115546 A1 6/2004 Tong et al.

* cited by examiner

*Primary Examiner*—John L Goodrow
(74) *Attorney, Agent, or Firm*—Carter, DeLuca, Farrell & Schmidt, LLP

(57) ABSTRACT

Methods for making dispersions, which are of various rheologies, various pigment/binder ratios, various particle sizes, and possess less impurities or large particles are provided. These dispersions may be utilized to form layers of photoreceptors.

7 Claims, 1 Drawing Sheet

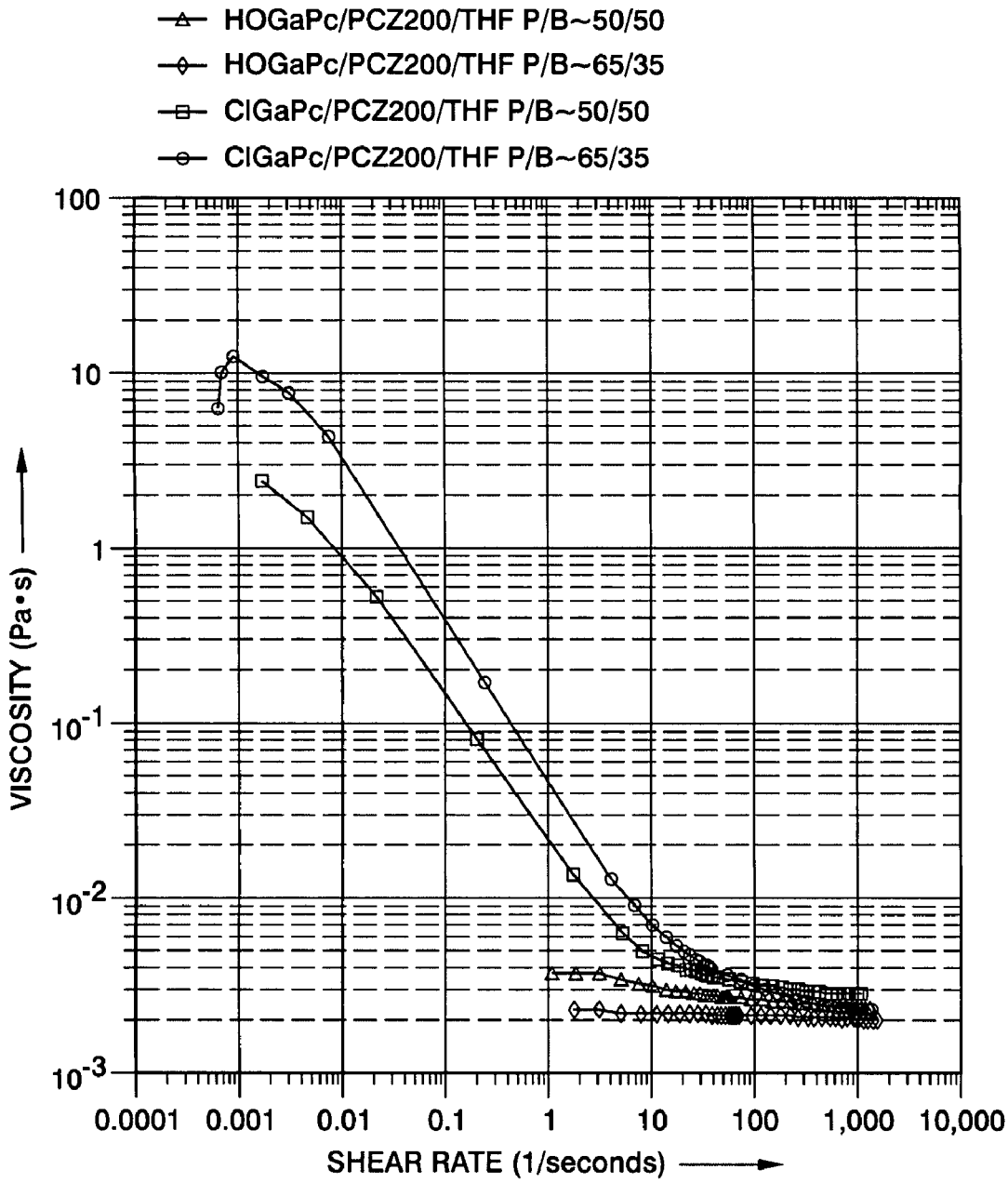
HOGaPc/PCZ200/THF P/B~50/50
HOGaPc/PCZ200/THF P/B~65/35
ClGaPc/PCZ200/THF P/B~50/50
ClGaPc/PCZ200/THF P/B~65/35
100
10
1
10-1
10-2
10-3
VISCOSITY (Pa•s)
0.0001
0.001
0.01
0.1
1
10
100
1,000
10,000
SHEAR RATE (1/seconds)

PHOTORECEPTORS

BACKGROUND

The present disclosure relates to imaging members and, more specifically, to methods for making dispersions, which are of various rheologies, various pigment/binder ratios, various particle sizes, and possess less impurities or large particles. These dispersions, in turn, may be utilized to form layers of imaging members and photoreceptors.

Electrophotographic photoreceptors may be in the form of plates, rigid drums, flexible belts, and the like. Electrophotographic photoreceptors may be prepared with either a single layer configuration or a multilayer configuration. Multilayered photoreceptors may include a substrate, a conductive layer, an optional hole blocking layer, an optional adhesive layer, a charge generation layer, a charge transport layer, an optional overcoating layer and, in some belt embodiments, an anticurl backing layer. In the multilayer configuration, the active layers of the photoreceptor are the charge generation layer (CGL) and the charge transport layer (CTL).

One technique for coating cylindrical or drum shaped photoreceptor substrates to form these layers, including charge generation layers, involves dipping the substrates in coating baths. For example, baths used for preparing charge generation layers may be prepared by dispersing photoconductive pigment particles in a solution containing a film forming binder. Newtonian dispersions may be utilized for dip coating since uniformity in the charge generation layer is more likely to occur. Methods for forming such Newtonian dispersions include those disclosed in U.S. Pat. No. 6,057,075, the disclosure of which is hereby incorporated by reference in its entirety, wherein a stable Newtonian coating dispersion may be formed by preparing a first stable Newtonian dispersion, and adding a polymer to said dispersion to form the stable Newtonian coating dispersion. The dispersion of U.S. Pat. No. 6,057,075 exhibits no yield point (the minimum force or shear stress required to initiate flow of a non-Newtonian dispersion).

Flexible photoreceptor belts are often fabricated by depositing layers of photoactive coatings onto long webs which are thereafter cut into sheets. Layers of such belt photoreceptors, such as charge generation layers, are often applied to belts by slot or slide coating of a dispersion.

Depending on the coating facility and the actual dispersion system utilized, different rheological properties of dispersions may be required for coating a photoreceptor. For example, while a Newtonian dispersion with no yield point may be adequate to form a uniform coating on a drum photoreceptor, a non-Newtonian dispersion with a yield point may be desirable for fast freezing-in the coated film of a dispersion with low viscosity on a flexible belt or web photoreceptor device. However, difficulties arise in utilizing non-Newtonian dispersions to coat belt or web photoreceptors due, in part, to the fact that it is not easy to uniformly mill the entire non-Newtonian dispersion and that undesirable heavy impurity particles can not be easily removed from the dispersion. Therefore, some heavy impurity particles or large particles that are greater in size than the acceptable size of the particulate additive for the given layer, may be present in the millbase. Under-milled particles and heavy impurities in dispersions utilized to form charge generation layers in photoreceptors are believed to be a primary cause of charge deficient spots (background/spots, and the like, sometimes referred to herein as CDS) in xerographic prints.

Methods which may be utilized to attempt to reduce these CDS include centrifugation and filtration of the dispersion to remove large particles/contaminants. However, as noted above, for some manufacturing processes it may be desirable to utilize non-Newtonian dispersions to form charge generation layers. For non-Newtonian dispersions, it may be extremely difficult, if not impossible, to utilize centrifugation to separate contaminants from the dispersion as the flocculated dispersion may completely separate, thereby breaking up the dispersion into its individual components.

The size of pigment particles in a charge generation layer and the distance between pigment particles within the charge generation layer may have a significant effect on ghosting performance. Ghosting is an image memory effect wherein a faint residual image appears when a new image is printed. Ideally, the distance between pigment particles within the charge generation layer should be as short as possible. For a given particle size, the distance between pigment particles, sometimes referred to herein as the particle separation distance, can be reduced by increasing the pigment to binder ratio (P/B ratio) of the dispersion. Alternatively, the particle size can be reduced at a constant P/B ratio. One drawback with these methods, however, is that they both may lead to an unstable dispersion as the P/B ratio continues to increase or the particle size is reduced below a certain level. For example, some methods for processing dispersions suitable for forming charge generation layers include mixing all components, for example solvents, binder solutions and pigments, with roughly the desired final P/B ratio; milling the dispersion to an endpoint particle size; diluting the dispersion to a given solids content; centrifuging to remove large under-milled particles and heavy impurities; and diluting the resulting dispersion to the desired final solids content for coating. While this process may enhance the stability of resulting dispersions, the achievable P/B ratio may be limited to a maximum value, depending upon the particle size, solids content, and solvent ratio. Without changing the formulation, a further increase in P/B, increase in % solids content, or a reduction of particle size while maintaining the dispersion stability may be extremely difficult, if not impossible, to obtain by milling alone.

The cost to develop different coating dispersion formulations for different layers of a photoreceptor, and the need to change dispersions for different products in the manufacturing process, greatly increases the costs to manufacture photoreceptors. Economical methods for developing these layers thus remain desirable.

SUMMARY

The present disclosure provides methods for producing dispersions having desired pigment/binder ratios and dispersions produced by these methods. In embodiments, the present disclosure provides methods which includes contacting a particulate additive and a first binder resin in a liquid to form a Newtonian millbase, centrifuging the millbase to remove impurities and to obtain a supernatant, concentrating the supernatant by re-centrifugation and removing some or all of the supernatant of the second centrifugation to form a concentrate, optionally washing the concentrate with a solvent, and contacting the concentrate with a let down solution comprising a solvent and an optional second binder resin to obtain a dispersion, wherein the dispersion may be Newtonian, near-Newtonian, or non-Newtonian.

In other embodiments, the present disclosure provides methods for fabricating charge generation layers of photoreceptors. These methods may include, in embodiments, contacting a first binder resin, a pigment and a liquid to form a Newtonian millbase, centrifuging the Newtonian millbase to remove impurities and to obtain a supernatant, concentrating the supernatant by re-centrifugation and removing some or all of the supernatant of the second centrifugation to form a concentrate, optionally washing the concentrate with a solvent, contacting the concentrate with a let down solution comprising a second binder resin and a solvent to obtain a dispersion having a ratio of pigment to binder of from about 85:15 to about 0.5:99.5 by weight, and forming a charge generation layer on a photoreceptor by applying the dispersion to a previously applied layer of the photoreceptor, wherein the dispersion may be Newtonian, near-Newtonian, or non-Newtonian.

In yet other embodiments, the present disclosure provides methods for fabricating charge generation layers of photoreceptors which include contacting a first binder resin, a pigment and a liquid to form a Newtonian millbase, centrifuging the Newtonian millbase at a rate of from about 1000 rpm to about 10000 rpm for a period of time of from about 5 minutes to about 2 hours to remove impurities and to obtain a supernatant, concentrating the supernatant by re-centrifugation at a rate of from about 2000 rpm to about 40000 rpm for a period of time of from about 10 minutes to about 4 hours and removing some or all of the supernatant of the second centrifugation to form a concentrate, optionally washing the concentrate with a solvent, contacting the concentrate with a let down solution comprising a second binder resin and a solvent to obtain a dispersion having a ratio of pigment to binder of from about 85:15 to about 0.5:99.5 by weight, and forming a charge generation layer on a photoreceptor by applying the dispersion to a previously applied layer of the photoreceptor, wherein the dispersion may be Newtonian, near-Newtonian, or non-Newtonian, and wherein the configuration of the charge generation layer is selected from the group consisting of belt and web.

Utilizing the methods of the present disclosure, one can first prepare a stable dispersion at a lower pigment/binder ratio and then remove excess binder from the system by centrifugation to achieve a targeted higher pigment/binder ratio and, finally, re-disperse the dispersion.

Photoreceptors possessing such layers are also provided.

BRIEF DESCRIPTION OF THE DRAWINGS

Various embodiments of the present disclosure will be described herein below with reference to the figure wherein:

The FIGURE includes a graph showing the rheology of samples of dispersions produced in accordance with the present disclosure.

DETAILED DESCRIPTION OF THE PREFERRED EMBODIMENTS

In accordance with the present disclosure, a double centrifugation process, sometimes referred to herein as fractionation, may be utilized to separate impurities from a dispersion while obtaining a desired pigment/binder ratio in the final dispersion. The double centrifugation process improves dispersion stability with either high P/B ratios and/or very small particle sizes. The process of the present disclosure includes, in embodiments: processing dispersions at an initially lower P/B ratio to a targeted fine particle stage; centrifuging the dispersion to remove under-milled large particles and/or heavy impurities; concentrating the supernatant from the first centrifugation to collect the desired particles and discard excess free binder (the supernatant from the second centrifugation); and re-dispersing the fine particles in the concentrate obtained after the second centrifugation in additional binder and/or solvent to obtain a fine dispersion with a high P/B ratio for forming a charge generation layer. The methods of the present disclosure thus permit the preparation of a first stable dispersion at a lower P/B ratio, followed by removal of excess binder from the system by centrifugation to achieve a targeted higher P/B ratio, followed by re-dispersing the particles to obtain a dispersion with a higher P/B ratio. Depending on the amount of supernatant being separated from the system, stable dispersions with increased P/B ratio thus can be achieved.

By adding a second centrifugation step, most free binder not adsorbed on pigment particles can be removed resulting in a dispersion for producing a charge generation layer with a P/B ratio higher than that could be obtained utilizing conventional methods. An extra-high P/B ratio may thus be obtained in the particulate recovered from the concentrate after the second centrifugation which allows more flexibility in obtaining a desired final P/B ratio obtained by the addition of the second binder solution to obtain the dispersion. This dispersion, in turn, may be utilized to produce a charge generation layer which correlates to the sensitivity of the dispersion and its rheological properties. Utilizing methods of the present disclosure, a stable dispersion at a lower P/B ratio may first be prepared and excess binder may then be removed from the system by centrifugation to achieve a targeted higher P/B ratio.

Depending upon the nature of the substrate to which the dispersions of the present disclosure are to be applied and the method selected for coating, the dispersions can be formulated to exhibit Newtonian, near-Newtonian, or non-Newtonian rheological properties to comply with the coating conditions for the photoreceptor. In embodiments, Newtonian refers, for example, to a phenomenon that the shear rate of a fluid increases linearly with shear stress and shear viscosity does not vary with shear rate. In embodiments, non-Newtonian includes near-Newtonian and refers, for example, to a phenomenon that the shear rate of a fluid does not increase linearly with shear stress and the viscosity varies as the shear rate is varied. A dispersion produced by the methods of the present disclosure may be formulated to exhibit non-Newtonian or near-Newtonian properties and may be applied to a web or belt photoreceptor. In other embodiments, a dispersion produced in accordance with the present disclosure may possess Newtonian properties.

In embodiments, dispersions obtained by the processes of the present disclosure include particulate additives. A Newtonian millbase or masterbatch may be prepared by combining a particulate additive, a binder resin, and a liquid. Dispersions for forming charge transport layers may be prepared with hole transport molecules and/or additional particulate additives including low surface energy fluoropolymers, metal oxides and/or non-metal oxides; charge generation layers may be prepared with pigments as the particulate additive; overcoat layers may be prepared with low surface energy fluoropolymers, metal oxides and/or non-metal oxides as the particulate additive, and the like.

In embodiments, the methods of the present disclosure may be utilized to form dispersions for forming charge generation layers of photoreceptors. Such dispersions may be Newtonian, non-Newtonian or near-Newtonian, in embodiments non-Newtonian or near-Newtonian. Examples of suitable binder resins for use in preparing the millbase dispersion for a charge generation layer include thermoplastic and thermosetting resins such as polycarbonates, polyesters including poly(ethylene terephthalate), polyurethanes including poly (tetramethylene hexamethylene diurethane), polystyrenes including poly(styrene-co-maleic anhydride), polybutadienes including polybutadiene-graft-poly(methyl acrylate-co-acrylontrile), polysulfones including poly(1,4-cyclohexane sulfone), polyarylethers including poly(phenylene oxide), polyarylsulfones including poly(phenylene sulfone), polyethersulfones including poly(phenylene oxide-co-phenylene sulfone), polyethylenes including poly(ethylene-co-acrylic acid), polypropylenes, polymethylpentenes, polyphenylene sulfides, polyvinyl acetates, polyvinylbutyrals, polysiloxanes including poly(dimethylsiloxane), polyacrylates including poly(ethyl acrylate), polyvinyl acetals, polyamides including poly(hexamethylene adipamide), polyimides including poly(pyromellitimide), amino resins including poly(vinyl amine), phenylene oxide resins including poly(2,6-dimethyl-1,4-phenylene oxide), terephthalic acid resins, phenoxy resins including poly(hydroxyethers), epoxy resins including poly([(o-cresyl glycidyl ether)-co-formaldehyde], phenolic resins including poly(4-tert-butylphenol-co-formaldehyde), polystyrene and acrylonitrile copolymers, polyvinylchlorides, polyvinyl alcohols, poly-N-vinylpyrrolidinones, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and the like, and combinations thereof. These polymers may be block, random, or alternating copolymers.

Examples of suitable polycarbonates which may be utilized to form the millbase dispersion include, but are not limited to, poly(4,4'-isopropylidene diphenyl carbonate) (also referred to as bisphenol A polycarbonate), poly(4,4'-diphenyl-1,1'-cyclohexane carbonate) (also referred to as bisphenol Z polycarbonate, polycarbonate Z, or PCZ), poly(4,4'-sulfonyl diphenyl carbonate) (also referred to as bisphenol S polycarbonate), poly(4,4'-ethylidene diphenyl carbonate) (also referred to as bisphenol E polycarbonate), poly(4,4'-methylidene diphenyl carbonate) (also referred to as bisphenol F polycarbonate), poly(4,4'-(1,3-phenylenediisopropylidene)diphenyl carbonate) (also referred to as bisphenol M polycarbonate), poly(4,4'-(1,4-phenylenediisopropylidene)diphenyl carbonate) (also referred to as bisphenol P polycarbonate), poly(4,4'-hexafluoroisppropylidene diphenyl carbonate).

The molecular weight of the binder resin used to form the millbase may be from about 10,000 to about 100,000, in embodiments from about 15,000 to about 50,000.

In embodiments, a single binder resin may be utilized to form the millbase of the present disclosure. In other embodiments, a mixture of more than one of the above binder resins can be used to form the millbase of the present disclosure. Where more than one binder resin is utilized, the number of binder resins can be from about 2 to about 4, in embodiments from about 2 to about 3.

A liquid or liquid mixture may be used in preparing the millbase. A liquid mixture may include from about 2 to about 4 liquids, in embodiments from about 2 to about 3 liquids. In embodiments, the liquid is a solvent for the binder resin, but not the particulate additive. The binder resin may be added to the liquid, in embodiments a solvent for the binder resin, to form a solution and the pigment then added to the solution to form the millbase dispersion. The liquid utilized should not substantially disturb or adversely affect other layers of the photoreceptor, if any. Examples of liquids that can be utilized in preparing the millbase include, but are not limited to, ketones, alcohols, aromatic hydrocarbons, halogenated aliphatic hydrocarbons, ethers, amines, amides, esters, mixtures thereof, and the like. Specific illustrative examples include cyclohexanone, acetone, methyl ethyl ketone, methanol, ethanol, butanol, amyl alcohol, toluene, xylene, monochlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, combinations thereof, and the like.

The binder resin in a liquid, which is a solvent for the binder resin, may be combined with a particulate additive to form the millbase dispersion. Thus, for example, in embodiments where a dispersion of the present disclosure is to be utilized to form a charge generation layer of a photoreceptor, the particulate additive may include a pigment. Suitable pigments which may be utilized include any photogenerating pigment within the purview of those skilled in the art such as metal phthalocyanines, metal free phthalocyanines, alkylhydroxyl gallium phthalocyanines, hydroxygallium phthalocyanines, perylenes including bis(benzimidazo)perylene, titanyl phthalocyanines, and the like. In embodiments, vanadyl phthalocyanines, Type V hydroxygallium phthalocyanines, and inorganic components such as selenium, selenium alloys, and trigonal selenium may be utilized as the pigment.

In embodiments, hydroxygallium phthalocyanaine (HOGaPc) may be utilized as the pigment in the charge generation layer. U.S. Pat. Nos. 5,521,306 and 5,473,064, the disclosures of each of which are hereby incorporated by reference in their entirety, describe HOGaPc and processes to prepare Type V hydroxygallium phthalocyanine. HOGaPc is most responsive at a wavelength of, for example, from about 550 nanometers to about 880 nanometers and is generally unresponsive to the light spectrum below about 500 nanometers. Typical wavelengths for photogeneration are from about 600 nanometers to about 850 nanometers and may include a broadband between the two wavelengths. In other embodiments, chlorogallium phthalocyanines (ClGaPc) may be used as the pigment.

Any suitable technique may be utilized to disperse the particulate additive in the binder resin or resins. The dispersion containing the pigment may be formed using, for example, attritors, ball mills, dynomills, paint shakers, homogenizers, microfluidizers, mechanical stirrers, in-line mixers, ultrasonic processors, CAVIPRO™ shear processors (from Five Star Technologies, Ltd., Cleveland, Ohio), or by any other suitable milling techniques.

Specific dispersion techniques which may be utilized include, for example, ball milling, roll milling, milling in vertical or horizontal attritors, sand milling, dynomilling and the like. The solids content of the mixture being milled can be selected from various concentrations of from about 0.2% to about 20%, in embodiments from about 5% to about 12%. Milling times using a ball mill or roll mill may be from about 6 hours and about 6 days, in embodiments from about 8 hours to about 3 days. If desired, the particulate additive with or without binder resin may be milled in the absence of a liquid prior to forming the final non-Newtonian coating dispersion.

For dispersions utilized to form charge generation layers, the amount of binder resin in the millbase can be from about 99.5% by weight to about 15% by weight of the millbase solids, in embodiments from about 65% by weight to about 20% by weight of the millbase solids. The amount of particulate additive, in embodiments pigment, in the millbase can be from about 0.5% by weight to about 85% by weight of the millbase solids, in embodiments from about 35% by weight to about 80% by weight of the millbase solids. The expression "solids" refers to the total pigment and binder components of the millbase dispersion.

It may be desirable for dispersion optimization to utilize methods such as centrifugation or filtration to remove undesired large particles, including large pigment particles, from the Newtonian millbase. Large pigment particles are believed to be a major cause of charge deficient spot problems. In embodiments, centrifuging may be utilized to remove undesired large particles in a first centrifuging step. Centrifuging in this first centrifuging step may occur at a rate of from about 1000 rpm to about 10000 rpm, in embodiments from about 2000 rpm to about 8000 rpm, for a period of time from about 5 minutes to about 2 hours, in embodiments from about 10 minutes to about 1 hour. Thus, the centrifugal force applied to the dispersion may be from about 500 g to about 25000 g, in embodiments from about 1000 g to about 20000 g, where g=9.8 meters/second$^2$. The centrifugation can be run at either discrete or continuous modes.

After this first centrifugation, the pellet thus obtained, sometimes referred to herein as the particulate or precipitate, which is primarily large under-milled pigment particles and heavy impurities, may be discarded to achieve better charge deficient spot (CDS) and background performance. After separating the pellet from the supernatant, the supernatant may then be centrifuged again for a longer time and/or at a higher speed to force nearly all of the pigment particles (and any adsorbed binder resin on the surface of the pigment particles) to fall out of solution and settle.

In embodiments, this second centrifuging may occur at a rate of from about 2000 rpm to about 40000 rpm, in embodiments from about 5000 rpm to about 10000 rpm, for a period of time from about 10 minutes to about 4 hours, in embodiments from about 20 minutes to about 2 hours. The centrifugal force applied to the dispersion during this second centrifugation may be from about 2000 g to about 1000000 g, in embodiments from about 3000 g to about 25000 g, where g=9.8 meters/second$^2$. The second centrifugation, like the first centrifugation described above, can be run at either discrete or continuous modes.

In other embodiments, additional centrifuging may occur at more than one additional speed for more than one additional time period. For example, the second centrifuging may occur at a rate of from about 2000 rpm to about 40000 rpm, in embodiments from about 5000 rpm to about 10000 rpm, for a period of time from about 10 minutes to about 4 hours, in embodiments from about 20 minutes to about 2 hours, followed by additional centrifuging at a rate of from about 2000 rpm to about 40000 rpm, in embodiments from about 5000 rpm to about 10000 rpm, for a period of time from about 10 minutes to about 4 hours, in embodiments from about 20 minutes to about 2 hours, followed by yet additional centrifuging at a rate of from about 2000 rpm to about 40000 rpm, in embodiments from about 5000 rpm to about 10000 rpm, for a period of time from about 10 minutes to about 4 hours, in embodiments from about 20 minutes to about 2 hours. There is no limit to the number of additional speeds that may be utilized during this second centrifugation step.

Alternatively, in embodiments the two centrifugation steps of the present disclosure may be arranged in a reversed sequence, i.e., to use the first centrifugation to separate excess free binder to increase the P/B ratio and the second centrifugation to remove under-milled large particles and/or heavy impurities.

In some embodiments, before the second centrifugation, additional solvent or additional other binder resin in solution may optionally be added to the dispersion so that the second centrifugation can be accelerated. As would be readily apparent to one skilled in the art, any additional solvent added would become a component of the final dispersion. The additional solvent may dilute the dispersion and therefore reduce its viscosity and accelerate the second centrifugation. In some cases, the introduction of the target binder resin into the solution may promote flocculation and therefore also accelerate the second centrifugation. Small amounts of flocculant, which has no negative impact to the following re-dispersing process and the performance of the final product, such as the electrical properties and print quality, can also be added to accelerate the second centrifugation.

After the second centrifugation, the supernatant containing primarily free binder can then be separated and discarded or recycled. In embodiments, this supernatant may be re-cycled in a continuous mode process. The concentrate thus obtained should have an extra-high P/B ratio upon discarding the free binder. A washing step with a solvent is optional at this point. Suitable solvents which may be utilized in this optional washing step can be the same as the original solvent, any solvent added to accelerate the second centrifugation, or a combination of both. Examples of suitable solvents include, but are not limited to, ketones, alcohols, aromatic hydrocarbons, halogenated aliphatic hydrocarbons, ethers, amines, amides, esters, combinations thereof, and the like. In embodiments, suitable solvents include cyclohexanone, acetone, methyl ethyl ketone, methanol, ethanol, butanol, amyl alcohol, toluene, xylene, monochlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, combinations thereof, and the like.

A binder solution similar to the binder solution described above for producing the millbase may then be added to the particulate obtained after the second centrifugation to form a dispersion having the target pigment/binder ratio and concentration so that a charge generation layer produced with such dispersion has the desired amount of pigment. In some embodiments, this second binder solution may be referred to as a let down composition. This let down composition may be the same or different as the binder solution utilized for producing the millbase. Similarly, the solvent utilized in the second binder solution or solutions to dilute the particulate obtained after the second centrifugation may be the same or different as the liquid utilized to form the millbase.

For example, if the desired pigment level in a charge generation layer is 50% by weight based on the total weight of the layer, a 80% pigment particulate obtained after the second centrifugation, for example, can be let down. In embodiments, the term "let down" can refer, for example, to the reduction of the percentage of pigment from z in the particulate obtained after the second centrifugation to z' in the final dispersion:

$$(w)(z)=(w')(z')$$

wherein w is the amount of the particulate obtained after the second centrifugation, z is the percentage of pigment in the particulate obtained after the second centrifugation, w' is the amount of the final dispersion utilized to produce a charge generation layer (in the same units as w), and z' is the percentage of pigment in the final dispersion utilized to produce a charge generation layer of the present disclosure.

Therefore, in the above example, if w' is 100 pounds, z' is 50% and z is 80%, then 62.5 pounds of the 80% particulate obtained after the second centrifugation would be needed to produce a final dispersion for a charge generation layer having a pigment concentration of 50%.

The particulate obtained after the second centrifugation in combination with the let down composition produces a charge generation dispersion which may be utilized to form a charge generation layer of a photoreceptor.

Where more than one binder resin is utilized in a let down composition, the number of binder resins in the let down composition can be from about 2 to about 4 binder resins, in embodiments from about 2 to about 3 binder resins. Where a solvent mixture is utilized to form the let down composition, the number of solvents can be from about 2 to about 4 solvents, in embodiments from about 2 to about 3 solvents. Alternatively, about one to about 4 let down solutions, in embodiments from about one to about 3 let down solutions, can be separately prepared and combined with the particulate obtained after the second centrifugation.

The amount of binder resin or resins in the let down composition can be from about 0% by weight to about 50% by weight of the let down composition, in embodiments from about 2% by weight to about 15% by weight of the let down composition.

The amount of let down solution added to the particulate obtained after the second centrifugation may be from about 5% to about 800% by weight of the particulate obtained after the second centrifugation, in embodiments from about 20% to about 200% by weight of the particulate obtained after the second centrifugation.

In embodiments, the particulate obtained after the second centrifugation may be re-dispersed in the let down solution by mild sonication or other processing methods including dynomilling, attritor milling, ball milling, the use of devices such as CAVIPRO™ shear processors (from Five Star Technologies, Ltd., Cleveland, Ohio), nanomizers, homogenizers, and the like.

In other embodiments, since the binder in the supernatant obtained after the second centrifugation is not adsorbed onto pigment particles, stable dispersions with increased P/B ratio can be achieved by re-dispersing the concentrate (primarily pigment particles with their surface covered by binder molecules) in the supernatant using a re-dispersing step with methods described above.

In theory, only binder molecules adsorbed on the surface of pigment particles may be necessary for dispersion stability. As adsorbed binder molecules remain attached to the pigment during centrifugation, it may be possible to remove all unused binder during the second centrifugation. In embodiments, it may be possible to carry out the second centrifugation at high enough speed and for long enough time to remove all solid pigment particles from the supernatant. As noted above, the supernatant including the remaining binder solution could then be discarded or re-cycled. Diluting with solvent only, the solid would then be re-dispersed by sonication or other proper methods. Only binder molecules adsorbed on pigment particles would remain, thus yielding the maximum P/B ratio possible for a stable dispersion. Naturally, the resulting P/B ratio would be dependent on the particle size (since total surface area is a function of particle size) and solids content. While binder molecules may detach from pigment particles as aggregates form during centrifugation, this processing method at least makes it possible to approach the theoretical maximum P/B ratio.

The binder solution or solvent added to the particulate obtained after the second centrifugation should be in an amount to produce the desired P/B ratio possessing desired rheological properties for the dispersion. Since the P/B ratio is very high in the particulate before adding additional target binder solution, a high P/B ratio can be maintained in the dispersion and resulting charge generation layer with a broad range of binder ratios in the dispersion thus produced.

While the specific examples described above may be utilized for preparing dispersions for producing charge generation layers for use in photoreceptors, the methods can also be applied to other dispersions which require higher P/B ratios or dispersions requiring higher particulate to resin ratios which may, in embodiments, be used for producing other layers of a photoreceptor.

The dispersion utilized to form the layer of a photoreceptor possesses the desired ratio of particulate additive to total binders, for a charge generation layer a ratio of pigment to binder, of from about 85:15 to about 0.5:99.5 by weight, in embodiments from about 85:15 to about 30:70 by weight. The dispersion utilized to form the layer of a photoreceptor possesses a desired concentration of solids of from about 2 weight percent to about 15 weight percent of the dispersion, in embodiments from about 3 weight percent to about 8 weight percent of the dispersion.

In embodiments the resulting dispersion thus produced may possess non-Newtonian, near-Newtonian, or Newtonian properties. In embodiments, the dispersion may be non-Newtonian.

The use of double centrifugation with the methods of the present disclosure provides several benefits. For example, the second centrifugation step serves to increase the P/B ratio in the particulate obtained making it possible to add more of the second binder and/or solvent while maintaining a sufficiently high P/B ratio in the final dispersion. Thus, a high P/B, non-Newtonian, near-Newtonian or Newtonian dispersion having impurities removed therefrom can be prepared.

Since the second centrifugation increases the P/B ratio, it is also possible to begin processing with a dispersion having a low P/B ratio and mill to a smaller particle size that otherwise would not have been stable at a higher P/B ratio. After the second centrifugation, the particulate may be re-dispersed in the second binder and/or solvent at the final solids content, which may be much higher than the solids content present in the millbase for milling. Thus, utilizing the methods of the present disclosure, one may be able to maintain stability of a high P/B ratio dispersion having smaller, finer particles at a desired final solids content.

The result is a dispersion possessing a high P/B ratio and fine particle size that has undergone centrifugation to remove impurities and has tunable rheological properties. These factors may contribute to increased photosensitivity and reduction of CDS. The proposed method is also advantageous in that a stable dispersion with smaller particles can be achieved by using a lower initial P/B ratio; the P/B ratio can be increased by removing free binder from the system via the second centrifugation; the final stable dispersion can be achieved by re-dispersing the rest of supernatant and the precipitate from the second centrifugation; the final P/B ratio can be adjusted by controlling the amount of supernatant removed; and the rheological properties of the final dispersion can be adjusted by controlling the type and amount of the additional binder and solvent added at the second centrifugation.

By utilizing the methods of the present disclosure, non-Newtonian dispersions may be prepared having a high P/B ratio suitable for forming layers on photoreceptors, including flexible belt or web photoreceptors, including active matrix photoconductor (AMAT) belt photoreceptors. Thus, in embodiments, a Newtonian millbase may be obtained, treated by a first centrifugation to remove large particles, treated by a second centrifugation to obtain a particulate having a high P/B ratio, and then combined with a let down solution to produce a non-Newtonian dispersion possessing a yield point which is suitable for application to flexible belt or web photoreceptors.

Once obtained, any suitable and/or conventional technique may be utilized to combine and thereafter apply the charge generation dispersion to another layer of a photoreceptor including, but not limited to, dip coating, roll coating, spray coating, rotary atomizers, die coating, slot coating, slide coating, and the like. The coating techniques may use a wide concentration of solids. The solids content may be from about 2 percent by weight to about 15 percent by weight based on the total weight of the dispersion, in embodiments from about 3 percent by weight to about 8 percent by weight based on the total weight of the dispersion. These solids concentrations are useful in dip coating, roll coating, spray coating, die coating, slot coating, slide coating, and the like.

In embodiments, the dispersions of the present disclosure may be applied to a substrate or any previously applied layer of a photoreceptor to form the desired layer, in embodiments a charge generation layer, of a belt photoreceptor by slot coating, slide coating, die coating, or roll coating techniques. In embodiments, dip coating may be used to apply the dispersion to form the desired layer, in embodiments a charge generation layer, of a drum photoreceptor. Drying of the deposited coating may be effected by any suitable conventional technique such as oven drying, infrared radiation drying, air drying and the like.

For charge generation layers, the pigment may be present in the charge generation layer of a photoreceptor in an amount of from about 0.5 percent to about 85 percent by weight of the charge generation layer and, in embodiments, from about 35 percent to about 80 percent by weight of the charge generation layer. Thus, the polymeric binder may be present in an amount from about 15 percent to about 99.5 percent by weight of the charge generation layer of a photoreceptor and, in embodiments, from about 20 percent to about 65 percent by weight of the charge generation layer, although the relative amounts can be outside these ranges. By utilizing two centrifugations and adjusting the materials utilized to form the millbase and let down compositions charge generation layers of photoreceptors with a desired ratio of pigment to binder may be formed. Furthermore, by selecting an appropriate second binder or solvent in the let down compositions and adjusting the ratio of the second binder to the first binder, for example, the binder in the Newtonian millbase, non-Newtonian dispersions may be prepared for forming charge generation layers.

Once formed, the charge generation layer containing pigment and binder resin may possess a thickness of from about 0.05 micrometers to about 10 micrometers, in embodiments from about 0.1 micrometers to about 5 micrometers, in other embodiments from about 0.2 micrometers to about 3 micrometers, although the thickness can be outside these ranges. The charge generation layer thickness is related to the relative amounts of pigment and binder resin. Lower pigment content compositions generally require thicker layers for photogeneration. It may be desirable to provide this charge generation layer in a thickness sufficient to absorb about 90 percent or more of the incident radiation which is directed upon it in the imagewise or printing exposure step. The optimal thickness of the charge generation layer depends upon factors such as electrical considerations including dark decay, charge depletion, and the like, mechanical considerations, the specific pigment selected, the thicknesses of the other layers, and whether a flexible photoconductive imaging member is desired.

The methods of the present disclosure may be utilized to form charge generation layers for use with any known configuration of photoreceptors. Suitable configurations of multi-layer photoreceptors include the photoreceptors described in U.S. Pat. Nos. 6,800,411, 6,824,940, 6,818,366, 6,790,573, and U.S. Patent Application Publication No. 20040115546, the disclosures of each of which are hereby incorporated by reference in their entirety. Photoreceptors herein may possess a charge generation layer (CGL), also referred to herein as a photogenerating layer, and a charge transport layer (CTL). Other layers, including a substrate, an electrically conductive layer, a charge blocking or hole blocking layer, an adhesive layer, and/or an overcoat layer, may also be present in the photoreceptor.

Suitable substrates which may be utilized in forming a photoreceptor include opaque or substantially transparent substrates, and may include any suitable organic or inorganic material having the requisite mechanical properties.

The substrate may be flexible, seamless, or rigid and may be of a number of different configurations such as, for example, a plate, a cylindrical drum, a scroll, an endless flexible belt, a web, and the like.

The thickness of the substrate layer may depend on numerous factors, including mechanical performance and economic considerations. For rigid substrates, the thickness of the substrate can be from about 0.3 millimeters to about 10 millimeters, in embodiments from about 0.5 millimeters to about 5 millimeters. For flexible substrates, the substrate thickness can be from about 65 micrometers to about 200 micrometers, in embodiments from about 75 micrometers to about 100 micrometers, for optimum flexibility and minimum stretch when cycled around small diameter rollers of, for example, about 19 millimeters in diameter. The entire substrate can be made of an electrically conductive material, or the electrically conductive material can be a coating on a polymeric substrate.

Substrate layers selected for imaging members of the present disclosure, which substrates can be opaque or substantially transparent, may include a layer of insulating material including inorganic or organic polymeric materials such as MYLAR® (a commercially available polymer from DuPont), MYLAR® containing titanium, a layer of an organic or inorganic material having a semiconductive surface layer such as indium tin oxide or aluminum arranged thereon, or a conductive material inclusive of aluminum, chromium, nickel, brass, or the like.

Any suitable electrically conductive material can be employed with the substrate. Suitable electrically conductive materials include copper, brass, nickel, zinc, chromium, stainless steel, conductive plastics and rubbers, aluminum, semi-transparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides including tin oxide and indium tin oxide, and the like.

After formation of an electrically conductive surface, a hole blocking layer may optionally be applied to the substrate layer. Generally, hole blocking layers (also referred to as charge blocking layers) allow electrons from the conductive layer to migrate toward the charge generation layer. Any suitable blocking layer capable of forming an electronic barrier to holes between the adjacent charge generation layer and the underlying conductive layer of the substrate may be utilized. Suitable blocking layers include those disclosed, for example, in U.S. Pat. Nos. 4,286,033, 4,291,110 and 4,338,387, the disclosures of each of which are hereby incorporated by reference in their entirety. Similarly, illustrated in U.S. Pat. Nos. 6,255,027, 6,177,219, and 6,156,468, the disclosures of each of which are hereby incorporated by reference in their entirety, are, for example, photoreceptors containing a hole blocking layer of a plurality of light scattering particles dispersed in a binder. For example, Example 1 of U.S. Pat. No. 6,156,468 discloses a hole blocking layer of titanium dioxide dispersed in a linear phenolic binder.

In embodiments, hole blocking layers utilized for negatively charged photoconductors may include, for example, polyamides including LUCKAMIDE® (a nylon type material derived from methoxymethyl-substituted polyamide commercially available from Dai Nippon Ink), hydroxy alkyl methacrylates, nylons, gelatin, hydroxyl alkyl cellulose, organopolyphosphazines, organosilanes, organotitanates, organozirconates, metal oxides of titanium, chromium, zinc, tin, silicon, combinations thereof, and the like. In embodiments the hole blocking layer may include nitrogen containing siloxanes. Nitrogen containing siloxanes may be prepared from coating solutions containing a hydrolyzed silane. Suitable hydrolyzable silanes include 3-aminopropyl triethoxy silane, N,N'-dimethyl 3-amino) propyl triethoxysilane, N,N-dimethylamino phenyl triethoxy silane, N-phenyl aminopropyl trimethoxy silane, trimethoxy silylpropyldiethylene triamine and mixtures thereof.

In embodiments, the hole blocking components may be combined with phenolic compounds, a phenolic resin, or a mixture including more than one phenolic resin, for example, from about 2 to about 4 phenolic resins. Suitable phenolic compounds which may be utilized may contain at least two phenol groups, such as bisphenol A (4,4'-isopropylidenediphenol), bisphenol E (4,4'-ethylidenebisphenol), bisphenol F (bis(4-hydroxyphenyl)methane), bisphenol M (4,4'-(1,3-phenylenediisopropylidene)bisphenol), bisphenol P (4,4'-(1,4-phenylene diisopropylidene)bisphenol), bisphenol S (4,4'-sulfonyldiphenol), bisphenol Z (4,4'-cyclohexylidenebisphenol), hexafluorobisphenol A (4,4'-(hexafluoro isopropylidene)diphenol), resorcinol, hydroxyquinone, catechin, and the like.

The hole blocking layer may be applied as a coating on a substrate or electrically conductive layer by any suitable technique within the purview of those skilled in the art such as spraying, die coating, dip coating, draw bar coating, gravure coating, silk screening, air knife coating, reverse roll coating, vacuum deposition, chemical treatment, and the like. For convenience in obtaining thin layers, the blocking layers may be applied in the form of a dilute solution, with the solvent being removed after deposition of the coating by techniques within the purview of those skilled in the art, including the application of a vacuum, heating and the like. Drying of the deposited coating may be effected by any suitable technique such as oven drying, infrared radiation drying, air drying, and the like.

The blocking layer may be continuous and have a thickness of from about 0.01 micrometers to about 30 micrometers, in embodiments from about 0.1 micrometers to about 20 micrometers.

An optional adhesive layer may be applied to the hole blocking layer. Any suitable adhesive layer may be utilized including, but not limited to, polyesters, polyamides, poly (vinyl butyral), poly(vinyl alcohol), polyurethane and polyacrylonitrile. Where present, the adhesive layer may be, for example, of a thickness of from about 0.001 micrometers to about 2 micrometers, in embodiments from about 0.01 micrometers to about 1 micrometer. Optionally, the adhesive layer may contain effective suitable amounts, for example from about 1 weight percent to about 10 weight percent, of conductive and nonconductive particles, such as zinc oxide, titanium dioxide, silicon nitride, carbon black, and the like, to provide further desirable electrical and optical properties to the photoreceptor of the present disclosure. Conventional techniques for applying an adhesive layer coating mixture to the hole blocking layer include spraying, dip coating, roll coating, wire wound rod coating, gravure coating, die coating, and the like. Drying of the deposited coating may be effected by any suitable technique such as oven drying, infrared radiation drying, air drying and the like.

In embodiments a photoreceptor may also include a charge transport layer attached to the charge generation layer. The charge transport layer may include a charge transport or hole transport molecule (HTM) dispersed in an inactive polymeric material. These compounds may be added to polymeric materials which are otherwise incapable of supporting the injection of photogenerated holes from the charge generation layer and incapable of allowing the transport of these holes therethrough. The addition of these HTMs converts the electrically inactive polymeric material to a material capable of supporting the direction of photogenerated holes from the charge generation layer and capable of allowing the transport of these holes through the charge transport layer in order to discharge the surface charge on the charge transport layer.

Suitable polymers for use in forming the charge transport layer are film forming binder resins within the purview of those skilled in the art. Examples include those polymers utilized to form the charge generation layer. Resin materials for use in forming the charge transport layer are electrically inactive resins including polycarbonate resins having a weight average molecular weight from about 20,000 to about 150,000, in embodiments from about 30,000 to about 120,000. Electrically inactive resin materials which may be utilized in the charge transport layer include poly(4,4'-dipropylidene-diphenylene carbonate) with a weight average molecular weight of from about 35,000 to about 40,000, available as LEXAN® 145 from General Electric Company; poly(4,4'-propylidene-diphenylene carbonate) with a weight average molecular weight of from about 40,000 to about 45,000, available as LEXAN® 141 from the General Electric Company; a polycarbonate resin having a weight average molecular weight of from about 50,000 to about 100,000, available as MAKROLON® from Farbenfabricken Bayer A.G.; a polycarbonate resin having a weight average molecular weight of from about 20,000 to about 50,000 available as MERLON® from Mobay Chemical Company; and a polycarbonate resin having a weight average molecular weight of from about 20,000 to about 80,000 available as PCZ from Mitsubishi Chemicals. Solvents such as methylene chloride, tetrahydrofuran, toluene, monochlorobenzene, or mixtures thereof, may be utilized in forming the charge transport layer coating mixture.

Any suitable charge transporting or electrically active molecules within the purview of those skilled in the art may be employed as HTMs in forming a charge transport layer on a photoreceptor. Suitable charge transporting molecules include, for example, aryl amines as disclosed in U.S. Pat. No. 4,265,990, the disclosure of which is hereby incorporated by reference in its entirety. In embodiments, an aryl amine charge hole transporting component may be represented by:

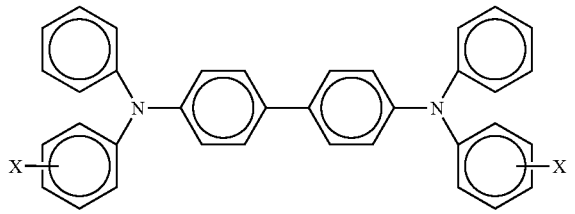

wherein X can be alkyl, halogen, alkoxy or mixtures thereof. In embodiments, the halogen may be a chloride. Alkyl groups may contain, for example, from about 1 to about 10 carbon atoms and, in embodiments, from about 1 to about 5 carbon atoms. Examples of suitable aryl amines include, but are not limited to, N,N'-diphenyl-N,N'-bis(alkylphenyl)-1,1-biphenyl-4,4'-diamine, wherein the alkyl may be methyl, ethyl, propyl, butyl, hexyl, and the like; and N,N'-diphenyl-N,N'-bis(halophenyl)-1,1'-biphenyl-4,4'-diamine, wherein the halo may be a chloro, bromo, fluoro, and the like substituent.

Other suitable aryl amines which may be utilized as an HTM in a charge transport layer include, but are not limited to, tritolylamine, N,N'-bis(3,4 dimethylphenyl)-N"(1-biphenyl)amine, 2-bis((4'-methylphenyl)amino-p-phenyl)1,1-diphenyl ethylene, 1-bisphenyl-diphenylamino-1-propene, triphenylmethane, bis(4-diethylamine-2-methylphenyl)phenylmethane, 4'-4"-bis(diethylamino)-2',2"-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(3"-methylphenyl)-(1,1'-biphenyl)-4,4'-diamine, and the like.

The weight ratio of the polymer binder to charge transport molecules in the resulting charge transport layer can be, for example, from about 30/70 to about 80/20. In embodiments the weight ratio of the polymer binder to charge transport molecules can be from about 35/65 to about 75/25, typically from about 40/60 to about 70/30.

Any suitable technique may be utilized to mix the polymer binder in combination with the hole transport material and apply same as a charge transport layer to a photoreceptor. In embodiments, it may be advantageous to add the polymer binder and hole transport material to a solvent to aid in formation of a charge transport layer and its application to a photoreceptor. Examples of solvents which may be utilized include aromatic hydrocarbons, aliphatic hydrocarbons, halogenated hydrocarbons, ethers, amides and the like, or mixtures thereof. In embodiments, a solvent such as cyclohexanone, cyclohexane, chlorobenzene, carbon tetrachloride, chloroform, methylene chloride, trichloroethylene, toluene, tetrahydrofuran, dioxane, dimethyl formamide, dimethyl acetamide, and the like may be utilized in various amounts. Suitable techniques for applying the charge transport layer include spraying, slot or slide coating, dip coating, roll coating, wire wound rod coating, and the like. Drying of the deposited coating may be effected by any suitable technique such as oven drying, infrared radiation drying, air drying and the like.

The thickness of the charge transport layer can be from about 2 micrometers and about 50 micrometers, in embodiments from about 10 micrometers to about 35 micrometers. The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generation layer, where present, is from about 2:1 to 200:1, in some embodiments as great as 400:1.

The charge generation layer, charge transport layer, and other layers may be applied in any suitable order to produce either positive or negative charging photoreceptors. For example, the charge generation layer may be applied prior to the charge transport layer, as illustrated in U.S. Pat. No. 4,265,990, or the charge transport layer may be applied prior to the charge generation layer, as illustrated in U.S. Pat. No. 4,346,158, the disclosures of each of which are hereby incorporated by reference in their entirety. When used in combination with a charge transport layer, the charge generation layer may be sandwiched between a conductive surface and a charge transport layer or the charge transport layer may be sandwiched between a conductive surface and a charge generation layer.

Optionally, an overcoat layer may be applied to the surface of a photoreceptor to improve resistance to abrasion. In some cases, an anti-curl back coating may be applied to the side of the substrate opposite the active layers of the photoreceptor (i.e., the CGL and CTL) to provide flatness and/or abrasion resistance where a photoreceptor possessing a web configuration is fabricated. These overcoating and anti-curl back coating layers are within the purview of those skilled in the art and may include thermoplastic organic polymers or inorganic polymers that are electrically insulating or slightly semiconductive. For example, overcoat layers may be fabricated from a dispersion including a particulate additive in a binder resin. Suitable particulate additives for overcoat layers include metal oxides such as aluminum oxide, non-metal oxides including silica or low surface energy polytetrafluoroethylene, and combinations thereof. Suitable binder resins include those described above as suitable for charge generation layers and/or charge transport layers, for example, polyvinyl acetates, polyvinylbutyrals, polyvinylchlorides, vinylchloride and vinyl acetate copolymers, carboxyl-modified vinyl chloride/vinyl acetate copolymers, hydroxyl-modified vinyl chloride/vinyl acetate copolymers, carboxyl-and hydroxyl-modified vinyl chloride/vinyl acetate copolymers, polyvinyl alcohols, polycarbonates, polyesters, polyurethanes, polystyrenes, polybutadienes, polysulfones, polyarylethers, polyarylsulfones, polyethersulfones, polyethylenes, polypropylenes, polymethylpentenes, polyphenylene sulfides, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly-N-vinylpyrrolidinones, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and combinations thereof. Overcoatings may be continuous and have a thickness of from about 0.5 micrometers to about 10 micrometers, in embodiments from about 2 micrometers to about 6 micrometers.

An example of an anti-curl backing layer is described in U.S. Pat. No. 4,654,284, the disclosure of which is hereby incorporated by reference in its entirety. In other embodiments, it may be desirable to coat the back of the substrate with an anticurl layer such as, for example, polycarbonate materials commercially available as MAKROLON® from Bayer Material Science. The thickness of anti-curl backing layers should be sufficient to substantially balance the total forces of the layer or layers on the opposite side of the supporting substrate layer. An anti-curl backing layer may have a thickness from about 10 micrometers to about 100 micrometers, in embodiments from about 15 micrometers to about 50 micrometers, and may be suitable for use with flexible photoreceptors.

While the above description has focused on the application of a charge generation dispersion to a multi-layered photoreceptor, including any adhesive layer, a suitable electrically conductive layer, or to a charge transport layer, it will be recognized that the charge generation dispersion of the present disclosure may be applied to other types of architectural devices such as single layer photoreceptors.

The dispersions of the present disclosure, when applied as a charge generation layer to a photoreceptor, provide excellent photoinduced discharge characteristics, cyclic and environmental stability, and acceptable charge deficient spot levels arising from dark injection of charge carriers.

While the above disclosure has discussed embodiments utilizing dispersions prepared herein for the formation of charge generation layers of photoreceptors, any layer of a photoreceptor having a particulate additive including, for example, an overcoat layer, charge transport layer, undercoat layer, hole blocking layer, anti-curl backing layer and the like, may be prepared utilizing the methods of the present disclosure with the two centrifugation steps. In embodiments, the same ratios of binder to particulate additive in the Newtonian millbase, the let down composition, and the resulting non-Newtonian, near-Newtonian, or Newtonian dispersion may be utilized following the same conditions described above for charge generation layers.

For example, the methods of the present disclosure may be utilized to adjust the rheology of a dispersion utilized to form a charge transport layer possessing hole transport molecules including N,N'-diphenyl-N,N'-bis(alkylphenyl)-1,1-biphenyl-4,4'-diamine, wherein the alkyl may be methyl, ethyl, propyl, butyl, hexyl, and the like; N,N'-diphenyl-N,N'-bis(halophenyl)-1,1'-biphenyl-4,4'-diamine, wherein the halo may be a chloro, bromo, fluoro, and the like, tritolylamine, N,N'-bis(3,4 dimethylphenyl)-N"(1-biphenyl)amine, 2-bis((4'-methylphenyl)amino-p-phenyl)1,1-diphenyl ethylene, 1-bisphenyl-diphenylamino-1-propene, triphenylmethane, bis(4-diethylamine-2-methylphenyl)phenylmethane, 4'-4"-bis(diethylamino)-2',2"-dimethyltriphenylmethane, N,N'-bis(alkylphenyl)-[1,1'-biphenyl]-4,4'-diamine wherein the alkyl is, for example, methyl, ethyl, propyl, n-butyl, and the like, N,N'-diphenyl-N,N'-bis(3"-methylphenyl)-(1,1'-biphenyl)-4,4'-diamine, and the like. In embodiments, the charge transport layer may also include particulate additives, for example metal oxides including aluminum oxide, non-metal oxides including silica, low surface energy fluoropolymers including low surface energy polytetrafluoroethylene, and the like, and combinations thereof.

Similarly, the methods of the present disclosure may be utilized to adjust the rheology of a dispersion utilized to form an overcoat layer possessing particulate additives, for example metal oxides including aluminum oxide, non-metal oxides including silica, low surface energy fluoropolymers including low surface energy polytetrafluoroethylene, and the like, and combinations thereof.

Processes of imaging, including xerographic imaging and printing, are also encompassed by the present disclosure. More specifically, photoreceptors having layers produced with the methods of the present disclosure can be selected for a number of different known imaging and printing processes including, for example, electrophotographic imaging processes such as xerographic imaging, and printing processes wherein charged latent images are rendered visible with toner compositions of an appropriate charge polarity. The imaging members may be sensitive in the wavelength region of, for example, from about 450 nanometers to about 900 nanometers, in embodiments from about 550 nanometers to about 850 nanometers; thus diode lasers can be selected as the light source. Moreover, the imaging members may be useful in color xerographic applications, in some embodiments high-speed color copying and printing processes.

The following Examples are being submitted to illustrate embodiments of the present disclosure. These Examples are intended to be illustrative only and are not intended to limit the scope of the present disclosure. Also, parts and percentages are by weight unless otherwise indicated.

EXAMPLES

Example 1

A dispersion was obtained using chlorogallium phthalocyanine (ClGaPc) Type B as pigment, carboxyl-modified chloride/vinyl acetate copolymer binder (VMCH, Dow Chemical, having a molecular weight of about 27000) as binder, a mixture of n-butyl acetate (NBA) and xylene as solvent. The materials were combined and dynomilled using a Dyno-Mill (Type KDL-Polit A, GlenMills Inc.). The P/B ratio was about 62/38, the solvent (binder) utilized was xylene/n-butyl acetate at a ratio of about 50/50, the solid wt % of the dispersion was about 10%, the dispersion had an RSI of about 0.026 at the milling endpoint. (A dispersion may be monitored for particle size reduction by relative scattering index (RSI). RSI is the ratio between the absorbance at about 1000 nm to the peak absorbance at about 776 nm. Absorbance was obtained utilizing a U-2000 UV-spectrophotometer from Hitachi.)

About 150 grams of this high P/B ratio dispersion was first centrifuged using a SORVALL® RC-5B Refrigerated Superspeed Centrifuge (from Dupont Instruments) and a 6×250 mL SORVALLO GSA Rotor, for about 25 minutes at about 5000 rpm and a temperature of about 20° C. and decanted to remove large particles and impurities. The RSI was about 0.026 and the solid content (%) was about 9.78% following the first centrifugation step. The remaining supernatant was mixed well and centrifuged again until the supernatant appeared less colored. The additional centrifuge steps were conducted as follows: for about 40 minutes at about 7500 rpm, followed by another 40 minutes at about 7500 rpm, followed by about 60 minutes at about 10000 rpm. The solution was inspected but not disturbed or mixed between these centrifugation steps. Next, about two thirds of the supernatant was poured out and separately saved. The solid and remaining solution was diluted to about 7% solids with additional xylene/n-butyl acetate at a ratio of about 50/50, mixed, and re-dispersed by sonication for about 160 seconds, at about 10% power using a Virsonic Digital Ultrasonic Homogenizer, Model #274506, 550 watts (commercially available from The VirTis Company). The sonication time was determined by the RSI. The intent was to achieve roughly the same RSI as was measured after the first centrifugation, so the particle size remained constant. After sonication the RSI was about 0.028, and after ageing two days (rolling constantly) the RSI was about 0.027, which confirmed the stability of the resulting dispersion.

Thermogravimetric analysis (TGA), conducted using a TGA TA2950 (commercially available from TA Instruments), showed that the P/B ratio was increased from the initial ratio of about 60/40 (after the first centrifugation) to about 73.5/26.5. The solids content of the supernatant from the second centrifugation was about 4.03%, indicating that it was primarily binder solution. Thus, the final sample possessed an increased P/B ratio.

Example 2

A second experiment was performed to mill a low P/B dispersion to very small particle size followed by increasing the P/B ratio by centrifugation. A mixture of a dymomilled and centrifuged ClGaPc/VMCH/xylene/NBA dispersion (using xylene/n-butyl acetate at a ratio of about 59/41, solid weight % of about 8.76%, and a P/B ratio of about 60/40) was let down to a P/B ratio of about 50/50 with about 10% VMCH/xylene/NBA solution (VMCH is a carboxyl-modified vinyl chloride/vinyl acetate copolymer commercially available from Dow Chemical, xylene/NBA=59/41) and dynomilled for about 430 minutes in continuous mode to an RSI of about 0.012. After about 25 minutes of centrifugation at about 5000 rpm in a first centrifugation step, the solid precipitate was discarded and the RSI and particle size of particles in the supernatant were about 0.012 and about 166 nm, respectively. Then, a second centrifugation was conducted on the supernatant for about 100 minutes centrifugation at about 7000 rpm, and approximately three quarters of the supernatant (solids content of about 6.92%) was removed. The solids and remaining solution was diluted with xylene/n-butyl acetate and sonicated for about 11 minutes at about 10-14% power so that the RSI was about 0.013. After ageing one day (rolling constantly), the RSI was about 0.017 and the particle size was about 169 nm (as determined by a modified BI90+ particle sizer from Brookhaven Instruments Corporation with a green laser as light source). After five days ageing the RSI remained at about 0.018, demonstrating that the dispersion remained stable.

The P/B ratio of the final dispersion increased from 50/50 to 62.6/37.4 from the second centrifugation and a low RSI (0.018) was achieved.

Example 3

This example demonstrated the use of double centrifugation to remove impurities and create a high P/B ratio non-Newtonian dispersion for producing a charge generation layer.

A high P/B ratio dispersion was prepared from hydroxygallium phthalocyanine (HOGaPc), VMCH, and n-butyl acetate (NBA) so that the P/B ratio was about 65/35 and solids content was about 12%). This dispersion was milled to the normal endpoint (RSI=0.153) using dynomill. The actual solids content was measured and the millbase letdown to about 10.7% for centrifugation. The millbase was centrifuged at about 5000 rpm for about 25 minutes at about 20° C. (using a SORVALL® RC-5B Refrigerated Superspeed Centrifuge, Dupont Instruments, and 6×250 mL SORVALL® GSA Rotor) and the precipitate, which included under-milled particles and heavy impurities, was discarded. The P/B ratio of the supernatant was estimated at about 61.7/38.3 based on the change of solid % before and after centrifugation. The supernatant was diluted with NBA at about 50% and then centrifuged at about 7000 rpm for about 120 minutes at 20° C. so that the majority of pigment settled as precipitate. The supernatant (primarily free binder) was then decanted and discarded. The precipitate was washed with tetrahydrofuran (THF) and then re-centrifuged at about 7000 rpm for about 60 minutes at about 20° C. to remove xylene, NBA and VMCH from the system. The supernatant was then decanted and discarded. The remaining solid was mixed with PCZ200/THF solution to make sample with an estimated P/B ratio of 65/35 or 50/50 (solids content about 10%). (PCZ 200 is poly(4,4'-diphenyl-1,1'-cyclohexane carbonate) having a molecular weight of about 20000 from Mitsubishi Chemicals.) The mixture was sonicated using a Virsonic Digital Ultrasonic Homogenizer, Model #274506, 550 watts (commercially available from The VirTis Company) at low power (about 12%) for about 15 minutes to redisperse the solid and then letdown to 6% solid for rheology evaluation. The FIGURE shows the rheological data of some of the samples. Note that it was still possible to tune the rheological properties by adding a combination of PCZ200 and VMCH solution in the final letdown.

For another sample, sonication was applied before mixing with PCZ200/THF solution where only THF was mixed with the precipitate. For another sample, the re-dispersing was applied by ball milling rather than sonication.

Example 4

This example demonstrated that double centrifugation could be used to create a fine CG in addition to the properties of Example 3. Similar procedures as Example 3 were repeated starting with a ClGaPcNVMCH/xylene/NBA dispersion which was milled to a smaller particle size (xylene/NBA=59/41, 8.6% solids, RSI=0.028). The first centrifugation was conducted at about 5000 rpm for about 15 minutes at about 20° C. The second centrifugation was conducted at about 7000 rpm for about 120 minutes. The final sonication was conducted at about 12% power for about 30 minutes. The rheological data, are also included in the FIGURE, shows the non-Newtonian behavior of the resulting dispersion.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for fabricating a charge generation layer of a photoreceptor comprising:

contacting a first binder resin, a pigment and a liquid to form a Newtonian millbase;

centrifuging the millbase to remove large particles and to obtain a supernatant;

concentrating the supernatant by re-centrifugation;

removing some or all of the supernatant of the second centrifugation to form a concentrate;

optionally washing the concentrate with a solvent;

contacting the concentrate with a let down solution comprising a second binder resin and a solvent to obtain a dispersion having a ratio of pigment to binder of from about 85:15 to about 0.5:99.5 by weight; and forming a charge generation layer on a photoreceptor by applying the dispersion to a previously applied layer of the photoreceptor, wherein the dispersion may be Newtonian, near-Newtonian, or non-Newtonian.

2. The method of claim 1, wherein centrifuging the Newtonian millbase occurs at a rate of from about 1000 rpm to about 10000 rpm for a period of time of from about 5 minutes to about 2 hours, and re-centrifuging the supernatant occurs at a rate of from about 2000 rpm to about 40000 rpm for a period of time of from about 10 minutes to about 4 hours.

3. The method of claim 1, wherein the Newtonian millbase is centrifuged at a rate of from about 2000 rpm to about 8000 rpm for a period of time of from about 10 minutes to about 1 hour, and re-centrifuging the supernatant occurs at a rate of from about 5000 rpm to about 10000 rpm for a period of time of from about 20 minutes to about 2 hours.

4. The method of claim 1, wherein the first binder resin and the second binder resin are the same or different and are selected from the group consisting of polyvinyl acetates, polyvinylbutyrals, polyvinylchlorides, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, polyvinyl alcohols, polycarbonates, polyesters, polyurethanes, polystyrenes, polybutadienes, polysulfones, polyarylethers, polyarylsulfones, polyethersulfones, polyethylenes, polypropylenes, polymethylpentenes, polyphenylene sulfides, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly-N-vinylpyrrolidinones, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and combinations thereof and the pigment is selected from the group consisting of metal phthalocyanines, metal free phthalocyanines, alkylhydroxyl gallium phthalocyanines, hydroxygallium phthalocyanines, and perylenes.

5. The method of claim 1, wherein the pigment is selected from the group consisting of bis(benzimidazo)perylene, titanyl phthalocyanines, vanadyl phthalocyanines, hydroxygallium phthalocyanines, chlorogallium phthalocyanines, selenium, selenium alloys, and trigonal selenium.

6. The method of claim 1, wherein the liquid utilized to form the Newtonian millbase and the solvent utilized to form the let down solution may be the same or different and are selected from the group consisting of ketones, alcohols, aromatic hydrocarbons, halogenated aliphatic hydrocarbons, ethers, amines, amides, esters, and mixtures thereof.

7. A method for fabricating a charge generation layer of a photoreceptor comprising:

contacting a first binder resin, a pigment and a liquid to form a Newtonian millbase;

centrifuging the Newtonian millbase at a rate of from about 1000 rpm to about 10000 rpm for a period of time of from about 5 minutes to about 2 hours to remove large particles and to obtain a supernatant;

concentrating the supernatant by re-centrifugation at a rate of from about 2000 rpm to about 40000 rpm for a period of time of from about 10 minutes to about 4 hours;

removing some or all of the supernatant of the second centrifugation to form a concentrate;

optionally washing the concentrate with a solvent;

contacting the concentrate with a let down solution comprising a second binder resin and a solvent to obtain a dispersion having a ratio of pigment to binder of from about 85:15 to about 0.5:99.5 by weight; and forming a charge generation layer on a photoreceptor by applying the dispersion to a previously applied layer of the photoreceptor, wherein the dispersion may be Newtonian, near-Newtonian, or non-Newtonian, and wherein the configuration of the charge generation layer is selected from the group consisting of belt and web.

* * * * *